US007975941B2

(12) United States Patent
Abramson et al.

(10) Patent No.: US 7,975,941 B2
(45) **Date of Patent: *Jul. 12, 2011**

(54) SHREDDER HEAD HAVING MOTOR DRIVEN SHREDDER BLADES AND AN ASSOCIATED SAFETY FEATURE AND/OR A METHOD OF SHREDDING MATERIAL

(76) Inventors: Aron Abramson, Brooklyn, NY (US); Charles Sued, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/719,943

(22) Filed: Mar. 9, 2010

(65) Prior Publication Data

US 2010/0308139 A1 Dec. 9, 2010

Related U.S. Application Data

(63) Continuation of application No. 11/684,782, filed on Mar. 12, 2007, now Pat. No. 7,673,822.

(51) Int. Cl.
*B02C 25/00* (2006.01)

(52) U.S. Cl. ..... 241/30; 241/101.3; 241/236

(58) Field of Classification Search ..... 241/30, 241/101.3, 236, 37.5
See application file for complete search history.

(56) References Cited

U.S. PATENT DOCUMENTS

| | | | | |
|---|---|---|---|---|
| 4,709,197 | A * | 11/1987 | Goldhammer et al. | 318/480 |
| 4,944,461 | A | 7/1990 | Farnsworth | |
| 7,673,822 | B2 * | 3/2010 | Abramson et al. | 241/30 |
| 2002/0014805 | A1 | 2/2002 | Liau | |
| 2005/0122721 | A1 | 6/2005 | Hori | |
| 2006/0016919 | A1 | 1/2006 | Castronovo | |
| 2006/0054725 | A1 | 3/2006 | Matlin | |
| 2006/0054727 | A1 | 3/2006 | Ko | |
| 2006/0219827 | A1 | 10/2006 | Matlin et al. | |

FOREIGN PATENT DOCUMENTS

JP 401304057 A 12/1989

* cited by examiner

*Primary Examiner* — Mark Rosenbaum
(74) *Attorney, Agent, or Firm* — Garcia-Zamor IP Law; Ruy M. Garcia-Zamor

(57) ABSTRACT

A shredder having a safety feature(s) that reduces potential safety hazards by detecting the temperature of a shredder motor and issuing a warning as an predetermined overheat temperature approaches.

17 Claims, 5 Drawing Sheets

SHREDDER HEAD HAVING MOTOR DRIVEN SHREDDER BLADES AND AN ASSOCIATED SAFETY FEATURE AND/OR A METHOD OF SHREDDING MATERIAL

CROSS REFERENCE TO RELATED APPLICATIONS

This application claims priority to and is a continuation of U.S. patent application Ser. No. 11/684,782, filed Mar. 12, 2007, which is hereby incorporated by reference herein as if fully set forth in its entirety.

BACKGROUND

The present invention is generally directed to shredders and, more specifically, to a safety feature(s) for shredders and/or a method of shredding material.

Conventional shredders can be operated in at least one of three operating modes. The first operating mode is an "off" mode in which the shredder blades are deactivated and no shredding of material can take place. The second operating mode is an "on" mode in which the shredder blades continually rotate to shred any material inserted into the shredder. The third operating mode is an "automatic" mode in which the shredder blades are automatically activated when the shredder detects that material is being inserted into the shredder. However, regardless of whether a shredder is operating in "on" mode or in "automatic" mode, continued heavy use can result in a shredder overheating. Typically, when a shredder motor overheats the shredder motor stops operation until a the temperature of the motor is reduced below a predetermined level.

Unfortunately, the first indication that a user has that the shredder motor is overheating is when the shredder stops functioning. This makes it difficult for a user to determine which materials caused the shredder to start to overheat. It also makes it difficult to modify the use of the shredder to avoid an overheat situation. Once a shredder has halted due to the overheating of the shredder motor, it can take twenty minutes or more for the shredder motor to cool sufficiently for the shredder to again be functional. Additionally, should the shredder fail to become inoperative during an overheat situation, a fire or burn hazard may be created. At a minimum, this can cause inefficiencies in business operations and, at a maximum, can result in the temporary cessation of business altogether.

It may be advantageous to provide a shredder and a method of shredding material that: preferably provides increased safety for users; preferably monitors motor temperature and issues a warning when a potential predetermined overheat condition is approaching.

SUMMARY

Briefly speaking, one embodiment of the present invention is directed to a shredder having motor driven shredder blades and an associated safety feature including a shredder head housing. The shredder head housing defines a slot adapted to receive material to be shredded. A plurality of shredder blades are disposed within the shredder head housing and are adapted to shred the material inserted into the slot. A motor is disposed within the shredder head housing and is configured to drive the plurality of shredder blades. A controller is disposed at least partially within the shredder head housing and is adapted to monitor a temperature of the motor. A light indicator mechanism is located on the shredder and is under operative control of the controller. The controller causes the light indicator mechanism to generate a first light condition when the motor is operating within normal temperature parameters. The controller causes the light indicator mechanism to generate a second light condition when the motor temperature exceeds normal temperature parameters but is less than a predetermined overheat temperature. The controller causes the light indicator mechanism to generate a third light condition when the motor temperature is equal to or greater than the predetermined overheat condition.

In a separate aspect, the present invention is directed toward a method of shredding material. The method includes: providing a shredder defining at least one slot for receiving material. The shredder includes a plurality of shredder blades adapted to shred the material inserted into the at least one slot. The plurality of shredder blades are driven by a motor. The method further includes: monitoring the temperature of the motor; providing different light conditions to indicate: when the temperature of the motor is within normal temperature parameters, when the temperature of the motor is above normal temperature parameters and below a predetermined overheat temperature, and when the temperature of the motor is equal to or greater than the predetermined overheat temperature.

In a separate aspect, the present invention is directed to a method of shredding material. The method includes providing a shredder defining at least one slot for receiving material. The shredder includes a plurality of shredder blades adapted to shred the material inserted into the at least one slot. The plurality of shredder blades are driven by a motor. The method further includes: monitoring the temperature of the motor; and providing an automatic warning when the temperature of the motor is above normal temperature parameters and below a predetermined overheat temperature to alert a user to a potential impending overheat condition.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
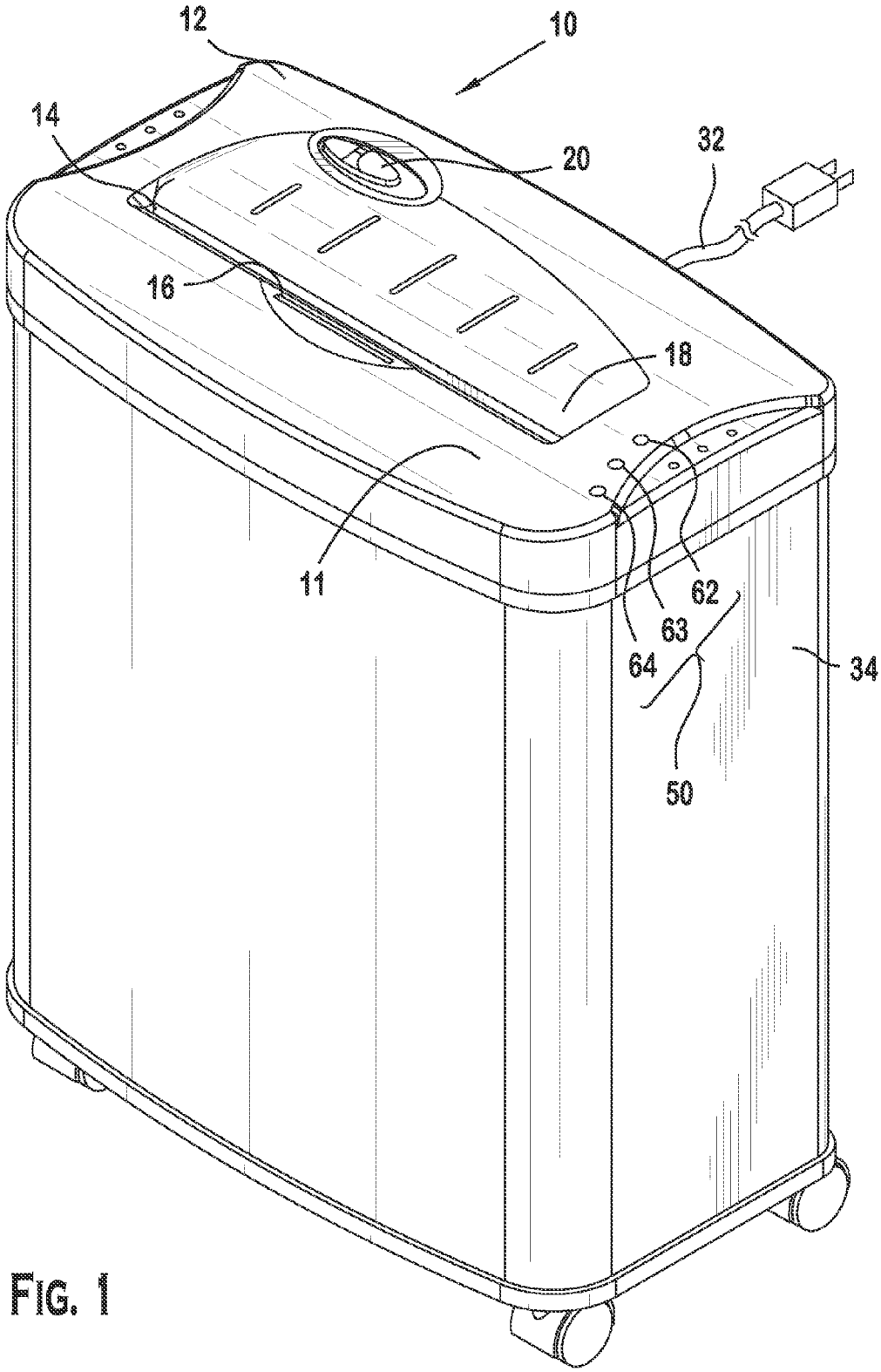
FIG. 1 is a perspective view of a shredder according to a preferred embodiment of the present invention; Along the right side of the shredder head housing are located first, second and third light emitting elements adapted to generate first, second, and third light conditions, respectively; A controller preferably causes the light indicator mechanism to generate a first light condition when the motor is operating within normal temperature parameters, the controller preferably causes the light indicator mechanism to generate a second light condition when the motor temperature exceeds normal temperature parameters but is less than a predetermined overheat temperature, the controller preferably causes the light indicator mechanism to generate a third light condition when the motor temperature is equal to or greater than the predetermined overheat condition.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "controller", as used in the claims and the corresponding portions of the specification, means "any one of a circuit, combination of sub controllers, an integrated circuit, a printed circuit board, or the like". The term "selectable control", as used in portions of the specification, means "any one of a physical switch, a touch switch, a button, a voice activated switch, a control knob, a remote control switch, or any other known operating mode selection device". The term "activate", as used with lights and/or speakers, means that the light and/or speaker has been manipulated to emit light and/or sound, respectively. The term "activated" as used with shredder blades means that the blades are moved in whatever manner results in shredding (i.e., that the blades 18 are operating for shredding). Thus, the term "activated" means that the blades are normally operational as per their designed operation for shredding as is the case when a shredder is left in the "on" mode. The term "light condition", as used in the claims and in the corresponding portions of the specification, means "any signal conveyed via light which can include conveying signals via light color, light variation, and/or a visual display". The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-6, wherein like numerals indicate like elements throughout, there are shown preferred embodiments of a shredder 10 having a safety feature according to the present invention. Briefly speaking, the shredder 10 senses the temperature of a motor 70 that drives the shredder blades and generates a warning when a potential impending overheat temperature condition is detected. This allows a user to modify use of the shredder 10 to attempt to avoid an overheat situation and the attendant risks and inconveniences.

Those of ordinary skill in the art will appreciate from this disclosure that the motor's temperature's normal operating parameters vary from one shredder to another based on the size of the motor, the positioning of the motor 70 within the shredder 10, and any insulation or air circulation affecting the motor 60. Accordingly, it is understood that when the motor's temperature is within "normal operating parameters", that the shredder can continue operation without risk of an overheat situation. Depending at least in part on the above design considerations, different shredders will be configured with a different predetermined overheat temperatures at which point it is advisable to temporarily halt shredder motor 70 operation.

Figure 2:
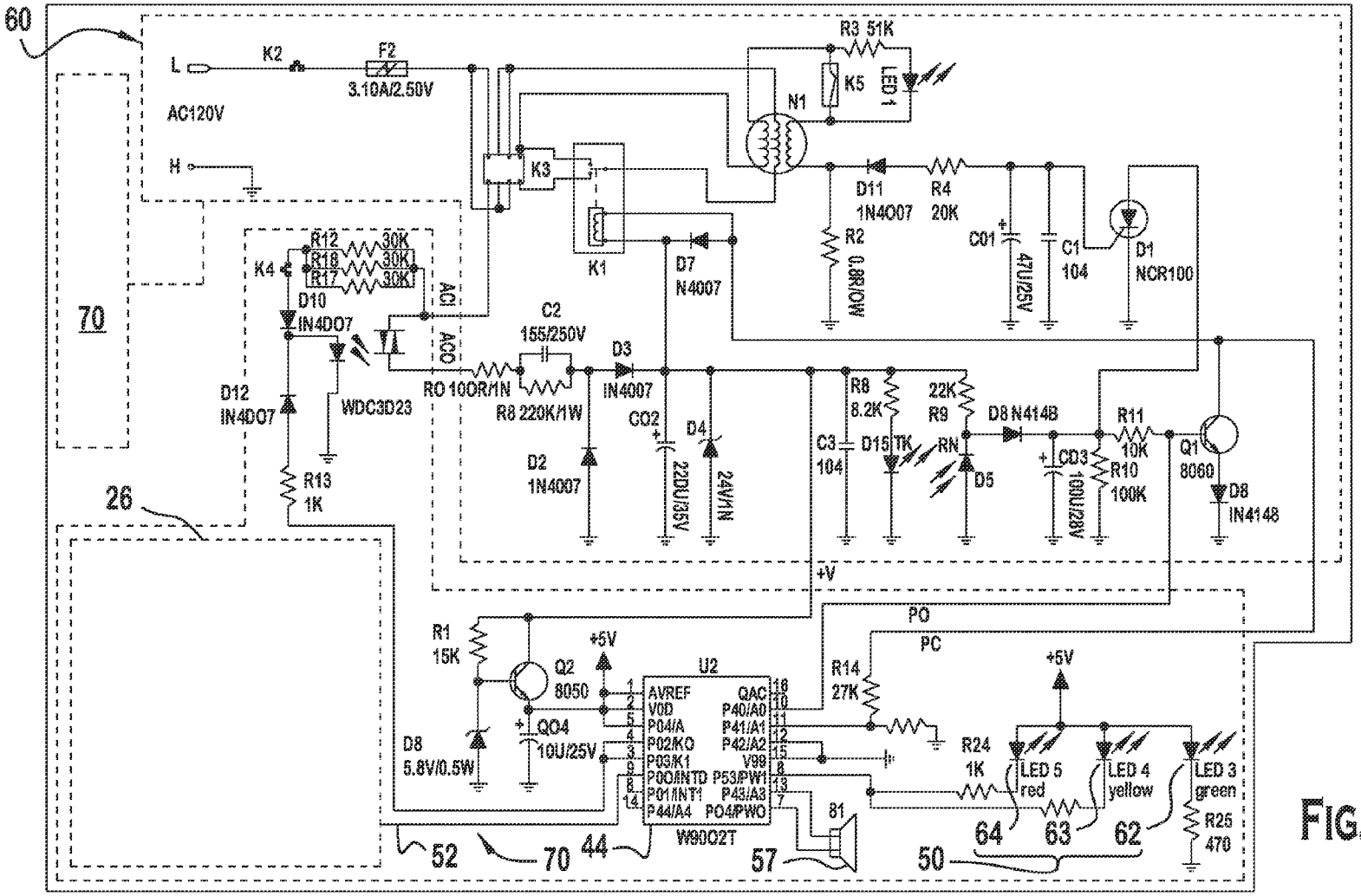
FIG. 2 is a circuit diagram of a preferred controller of the shredder of FIG. 1; The circuit diagram includes a speaker that can be used to provide an audible warning of a potential impending motor temperature overheat condition; the audible warning can be an alarm, a prerecorded voice message, or any other suitable audible warning.
Figure 2A:
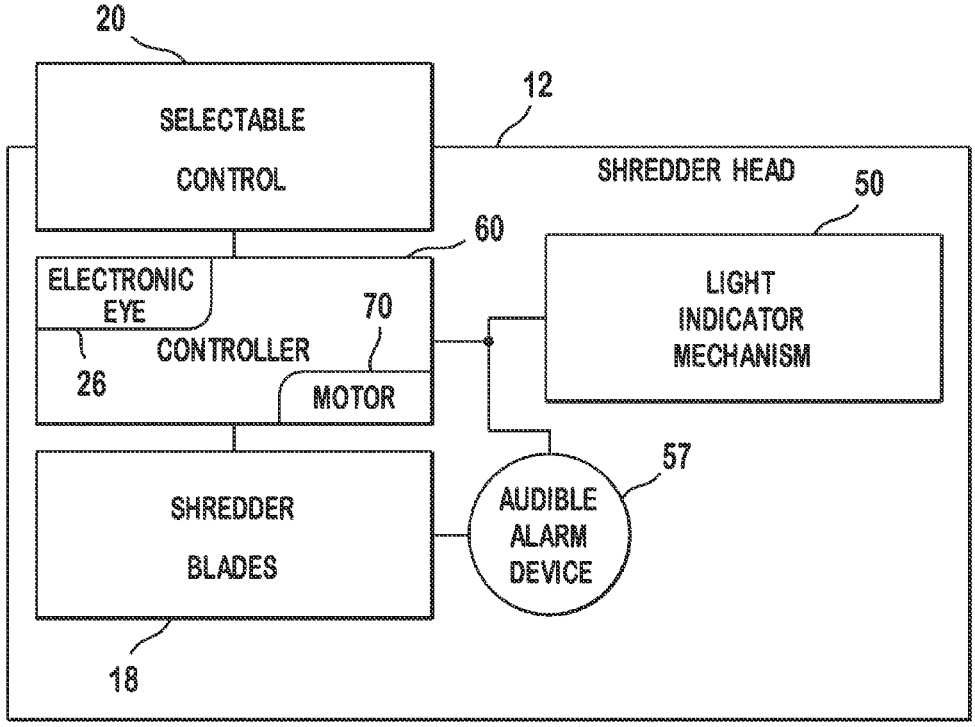
FIG. 2A is a schematic diagram which illustrates preferred components of the shredders of the present invention; The controller can be separate from or integrated with the motor without departing from the scope of the present invention.

Referring to FIGS. 1 and 2A, one embodiment of the present invention includes a shredder 10 having motor driven shredder blades 18. The shredder includes a shredder head housing 12 that defines at least one slot 14, 16 for inserting material to be shredded. The primary slot 14 preferably guides material to be shredded to shredder blades 18 that are driven by a motor 70 located in the shredder head housing 12. The plurality of shredder blades 18 are disposed within the shredder head housing 12 and are adapted to shred material inserted into one of the slots 14, 16. The first slot 14 is preferably used for paper documents and the second slot 16 is preferably used for more rigid documents, such as credit cards, compact discs, etc.

Figure 3:
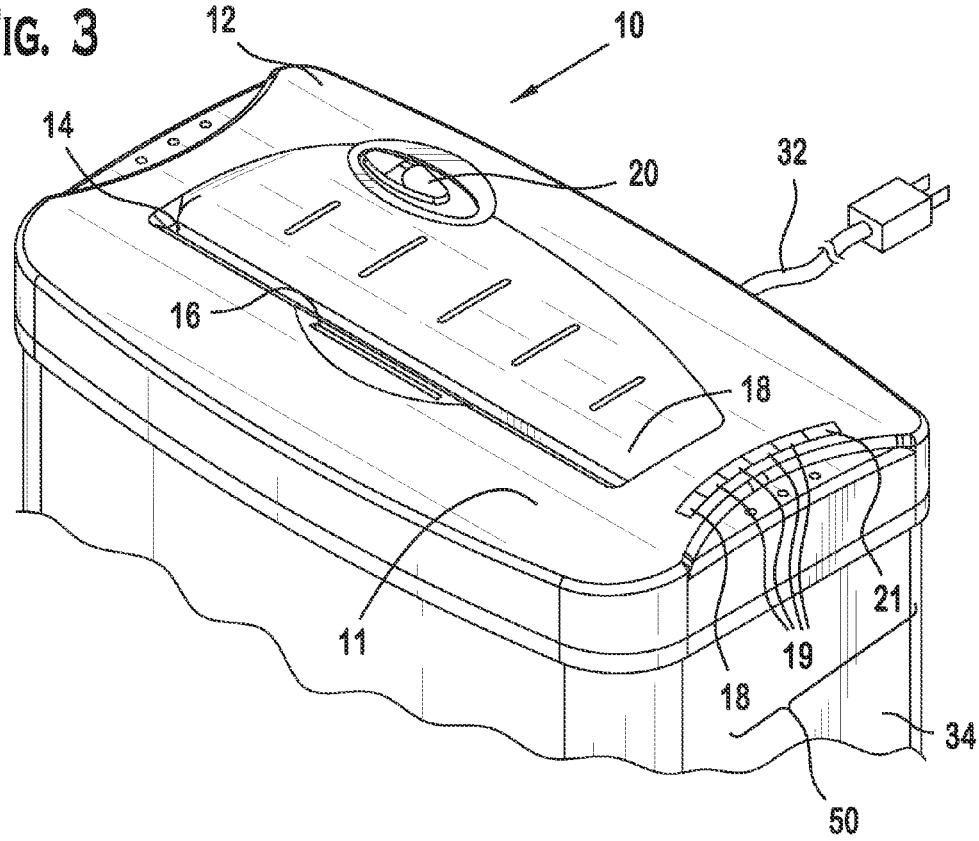
FIG. 3 is a broken away perspective view of a shredder according to a second preferred embodiment of the present invention; The second light emitting element comprises a plurality of lights that preferably activate sequentially as the temperature of the motor approaches the predetermined overheat temperature; Alternatively, the lights can blink with increasing frequency as an overheat situation approaches.
Figure 5:
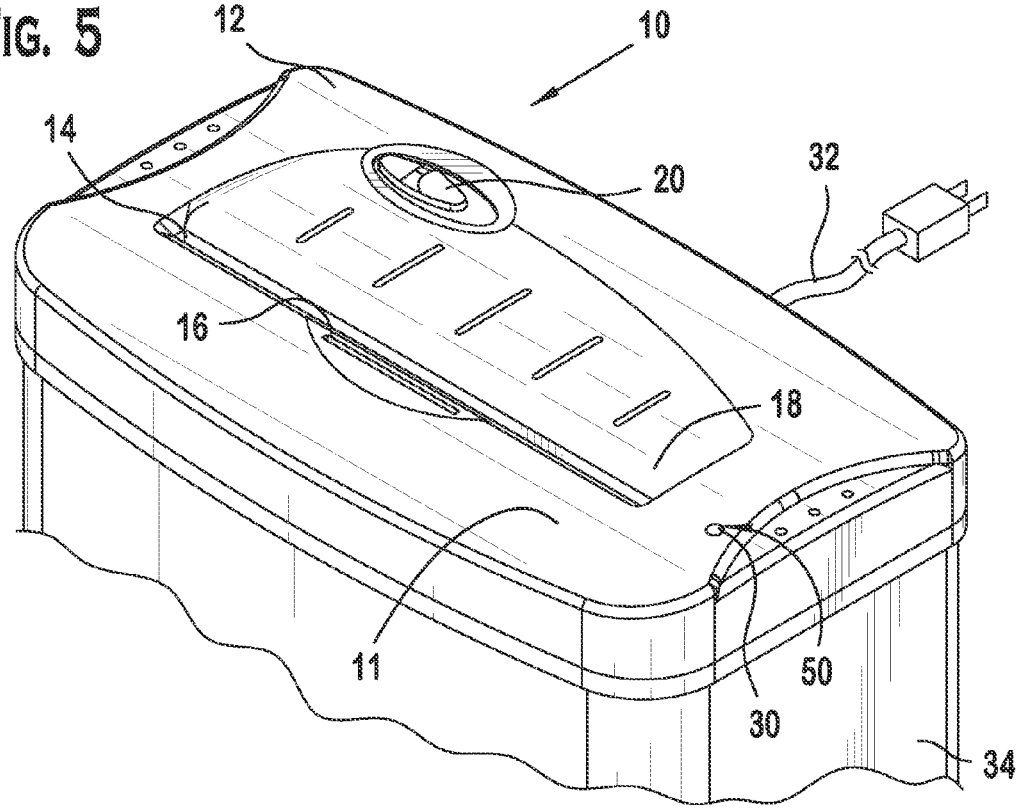
FIG. 5 is a broken away perspective view of a shredder according to a third preferred embodiment of the present invention; The light emitting element is preferably formed by a multi-color light emitting device, such as a multi-color light emitting diode (LED), a liquid crystal display, a plasma display, or the like; The controller causes the light indicator mechanism to generate a first light condition (emit a green light) when the motor is operating within normal temperature parameters, the controller causes the light indicator mechanism to generate a second light condition (emit a yellow light) when the motor temperature exceeds normal temperature parameters but is less than a predetermined overheat temperature, the controller causes the light indicator mechanism to generate a third light condition (emit a red light) when the motor temperature is equal to or greater than the predetermined overheat condition; Those of ordinary skill in the art will appreciate from this disclosure that light indicator mechanism can be configured to emit any color light for each of the three or more light conditions without departing from the scope of the present invention.

Referring to FIGS. 1, 3, and 5, while the preferred shredder head housing 12 has a generally rectilinear shape, those of ordinary skill in the art will appreciate from this disclosure that the shredder head housing 12 can have any shape without departing from the scope of the present invention. The shredder head may also include a bin full indicator or other operational indicators. Shredder head handles are preferably, but not necessarily, located on the left and right lateral sides of the shredder head housing 12 to allow easy lifting of the shredder head from the shredder basket 34.

The shredder preferably receives power from an outlet via a power conduit, such as an electrical cord, 32. However, the shredder can be powered by batteries or any other suitable power source.

Referring to FIGS. 1, 3, and 5, the shredder 10 includes a shredder head housing 12 defining at least one slot 14, 16 adapted to receive material to be shredded. When the shredder is in activated and detects inserted material, via an electronic eye 26 or any other suitable material detection mechanism, the shredder controller 60 activates the plurality of shredder blades 18 to shred the detected material. It is preferred, that the shredder blades 18 rotate upon activation. However, vibratory movement, reciprocating movement, or any other suitable shredding movement can be used when the shredding blades 18 are activated.

The shredder 10 may include a motor 70 disposed in the shredder head housing 12 and adapted to drive the plurality of shredder blades 18. The motor 22 may be considered separate from the controller 60 or can be integrated therewith without departing from the scope of the present invention. The controller 60 may include one or more sensors, such as an electronic eye, thermal sensor, or the like disposed within the shredder head housing 12 and adapted to detect the material inserted into a slot 14, 16 and/or the temperature of the shredder motor 70. The electronic eye is preferably, but not necessarily, formed by a diode pair comprising a light emitting diode and a light detecting diode. However, those of ordinary skill in the art will appreciate from this disclosure that any type of sensor(s) can be used to detect the insertion of material to be shredded without departing from the scope of the present invention.

Referring to FIGS. 1 and 2A, the controller 60 is preferably at least partially disposed within the shredder head housing 12 and is adapted to monitor the temperature of the motor 70. A light indicator mechanism 50 is located on the shredder 10 and is under operative control of the controller 60.

In one embodiment, it is preferred that the controller 60: causes the light indicator mechanism 50 to generate a first light condition when the motor is operating within normal temperature parameters; causes the light indicator mechanism 50 to generate a second light condition when the motor temperature exceeds normal temperature parameters but is less than a predetermined overheat temperature, and preferably causes the light indicator mechanism 50 to generate a third light condition when the motor temperature is equal to or greater than the predetermined overheat condition. Those of ordinary skill in the art will appreciate from this disclosure that the light indicating mechanism can provide a visual signal only when the motor temperature exceeds normal temperature parameters but is less than a predetermined overheat temperature without departing from the scope of the present invention. That is the light indicator mechanism 50 can not provide indication of normal operating temperatures or an existing overheat condition without departing from the scope of the present invention.

Referring to FIGS. 1 and 2, the light indicator mechanism 50 may comprise three light emitting elements 62, 63, 64 that each preferably emit light of a different color. It is preferred that each of the three light emitting elements 62, 63, 64 correspond to one of the first, second, and third light conditions. It is preferred that generally green light is emitted during the first light condition, that generally yellow light is emitted during the second light condition, and that generally red light is emitted during the third light condition. However, those of ordinary skill in the art that the light emitting elements 62, 63, and 64 can each emit the same color or any other colors without departing from the scope of the present invention.

Referring to FIGS. 1, 3, and 5, it is preferred that the light indicator mechanism 50 is formed by light emitting elements such as light emitting diodes. However, any suitable light emitting device can be used without departing from the scope of the present invention. For example, the light emitting elements 62, 63, 64 can be multi-color light emitting diodes, or liquid crystal components, or plasma components or the like without departing from the present invention.

Figure 4:
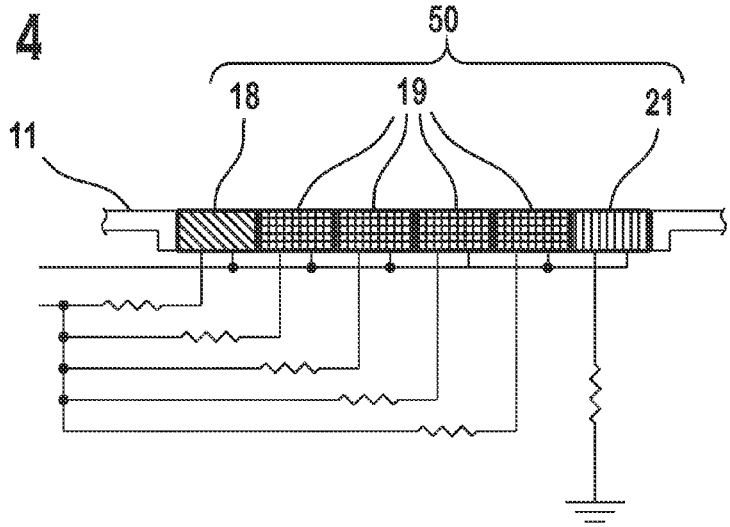
FIG. 4 is a schematic view of the first, second, and third light emitting elements that comprise the light indicator mechanism of the shredder of FIG. 3; The first light emitting element (located on the left side of FIG. 4) preferably generates a generally green light during a first light condition which indicates that the motor temperature is within normal temperature parameters; The second light emitting element is preferably formed by a series of lights that emit a generally yellow light and which activate in a sequential manner (or flash with increasing frequency) during a second light condition indicating the onset of an overheat condition; The third light emitting element (located on the right side of FIG. 4) preferably generates a generally red light when the motor temperature is equal to or greater than a predetermined overheat temperature.

Referring to FIGS. 3 and 4, the light indicator mechanism 50 may include a series of lights 18, 19, 21 organized in a row, or other pattern, having first and second ends. The series of lights activating sequentially from the first end toward the second end as the temperature of the motor 70 moves from within normal operating parameters toward the predetermined overheat temperature. The visual alarm can be replaced or supplemented by an audible alarm generated by an audible alarm device 57. The audible alarm can be a sound, ring, or a prerecorded voice alert or the like.

Figure 6:
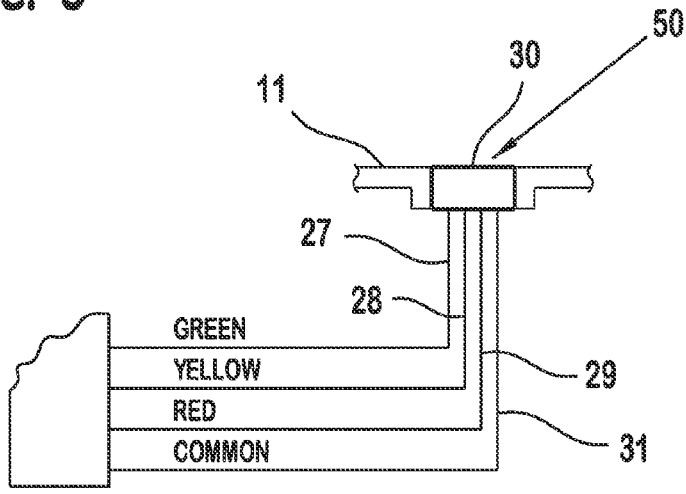
FIG. 6 is a schematic view of one possible multi-color light emitting device that can form the light indicating mechanism of the shredder of FIG. 5; Any of the embodiments shown in FIGS. 1-6 can use a single or combination visual impending overheat temperature warning (using a light condition) and an audible warning without departing from the scope of the present invention.

Referring to FIGS. 5 and 6, the light indicator mechanism 50 may include a multi-color light emitting device 30 that emits a different color light for each of the first, second, and third light conditions. Alternatively, the light indicator mechanism 50 may only emit a single color light and may use frequency of blinking the light to indicate an approaching potential overheat condition. It is preferred that the multi-color light emitting device 30 provides: generally green light during the first light condition; generally yellow light during the second light condition; and generally red light during the third light condition. However, any color or combinations of lights can be used without departing from the scope of the present invention.

Referring to FIGS. 1 and 2, the illustrated schematic is exemplary only. Those of ordinary skill in the art will appreciate from this disclosure that any suitable circuit(s) can be used without departing from the scope of the present invention. In the preferred circuitry, when an electric eye 26, or other sensor, detects paper to be shredded, the shredder blades 18 are activated. The controller 60 maintains the shredder 10 in normal operating condition while monitoring the temperature of the shredder motor 70. Any suitable thermistor or other suitable temperature sensor can be used for the controller 60 to monitor the motor temperature. The thermistor or other sensor can be separate from or built into the controller. It is understood that any suitable circuitry can be used with the shredder of the present invention without departing from the scope of the present invention.

A first sub controller 44 is preferably, but not necessarily, configured to deactivate the shredder blades 17 when an overheat condition is detected. The first controller 44 preferably activates the light indicator mechanism 50 and/or the audible alarm device 57 when an impending motor temperature overheat condition is detected. The warning light indicator mechanism may include multiple light emitting devices 62, 63, 64, as discussed above. The first controller 44 may activate a speaker 57 to emit a warning sound when the overheat condition is detected.

The present invention also includes methods of shredding material. The steps of the method need not be performed in the recited order. The methods of the present invention preferably use the shredder 10 described above. However, the methods of the present invention may operate with shredders having fewer or different components from those described above.

One preferred method of shredding material according to the present invention includes providing a shredder 10 that defines at least one slot 14, 16 for receiving material. The shredder includes a plurality of shredder blades 18 adapted to shred the material inserted into the at least one slot 14, 16. The plurality of shredder blades 18 are driven by a motor 70. The temperature of the motor 70 is monitored. Different light conditions may be provided to indicate: when the temperature of the motor is within normal temperature parameters, when the temperature of the motor is above normal temperature parameters and below a predetermined overheat temperature, and when the temperature of the motor is equal to or greater than the predetermined overheat temperature.

The method may include generating a generally green light when the motor is operating within normal temperature parameters; generating a generally yellow light when the motor temperature exceeds normal temperature parameters but is less than a predetermined overheat temperature; and generating a generally red light when the motor temperature is equal to or greater than the predetermined overheat condition. Referring to FIGS. 5 and 6, the method may include providing a multi-color light emitting device 30. A plurality of generally yellow lights may be provided and configured such that as the motor temperature rises toward the predetermined overheat temperature an increasing number of the plurality of yellow lights activate to indicate an approaching overheat condition.

Referring to FIGS. 1 and 2, the method may include providing different light conditions further comprises providing a green light emitting element; a yellow light emitting element; and a red light emitting element. The motor 70 may be deactivated when the temperature of the motor is equal to or greater than the predetermined overheat temperature.

The power to the motor 70 can be reduced when the temperature of the motor is above normal temperature parameters and below a predetermined overheat temperature to extend an amount of time remaining prior to the temperature of the motor becoming equal to or greater than the predetermined overheat condition. As desired, the motor 70 may be deactivated when the temperature of the motor 60 is equal to or greater than the predetermined overheat temperature.

Another preferred method of shredding material according to the present invention includes providing a shredder 10 that defines at least one slot 14, 16 for receiving material. The shredder includes a plurality of shredder blades 18 adapted to shred the material inserted into the at least one slot 14, 16. The plurality of shredder blades 18 are driven by a motor 70. The temperature of the motor 70 is monitored. An automatic warning is provided when the temperature of the motor 70 is above normal temperature parameters and below a predetermined overheat temperature to alert a user to a potential impending overheat condition.

Different light conditions may be generated to indicate: when the temperature of the motor is within normal temperature parameters, when the temperature of the motor is above normal temperature parameters and below a predetermined overheat temperature, and when the temperature of the motor is equal to or greater than the predetermined overheat temperature. A plurality of generally yellow lights can be provided and configured such that as the motor temperature rises toward the predetermined overheat temperature an increasing number of the plurality of yellow lights activate to indicate an approaching overheat condition.

In addition to the warning lights, or instead of, the warning may comprise generating an audible warning when the temperature of the motor is above normal temperature parameters and below a predetermined overheat temperature. The audible alarm may include a prerecorded audio message. The warning may comprise the generation of at least one of alphanumeric text and a symbol when the temperature of the motor is above normal temperature parameters and below a predetermined overheat temperature. The text and/or symbols can be provided via any suitable display, such as an LED display, LCD display, plasma display or the like.

It is recognized by those skilled in the art that changes may be made to the above described methods and/or shredder 10 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A method of shredding using a shredder having motor driven shredder blades and an associated safety feature, comprising:

providing a shredder head housing defining a slot adapted to receive material to be shredded;

providing a plurality of shredder blades disposed within the shredder head housing and adapted to shred the material inserted into the slot;

providing a motor disposed within the shredder head housing and configured to drive the plurality of shredder blades;

providing a controller disposed at least partially within the shredder head housing and adapted to monitor a temperature of the motor;

providing a light indicator mechanism located on the shredder and being under operative control of the controller, wherein the controller causes the light indicator mechanism to generate a first light condition when the motor temperature exceeds normal temperature parameters but is less than a predetermined overheat temperature, the controller causes the light indicator mechanism to generate a second light condition when the motor temperature is equal to or greater than the predetermined overheat condition; and sensing and directly measuring the motor temperature and generating appropriate signals via the light indicator mechanism to generate a warning when a potential impending overheat temperature is detected to allow a user to modify shredder use to attempt to avoid an overheat situation while continuing to operate the shredder to shred material without the motor being deactivated.

2. The method of claim 1, wherein the step of providing the light indicator mechanism further comprises the light indicator mechanism comprising three light emitting elements each emitting light of a different color and configured to generate the first and second light conditions; and reducing power to the motor when the motor temperature exceeds normal temperature parameters but is less than a predetermined overheat temperature to extend an amount of time remaining prior to the temperature of the motor becoming equal to or greater than the predetermined overheat condition.

3. The method of claim 1, wherein the step of providing the light indicator mechanism further comprises the light indicator mechanism comprising three light emitting elements, a first light emitting element providing generally yellow light while the light indicator mechanism is generating the first light condition, and a second light emitting element providing generally red light while the light indicator mechanism is generating the second light condition.

4. The method of claim 3, wherein the step of providing the light indicator mechanism further comprises the second light emitting element further comprising a plurality of generally yellow lights that activate sequentially as the temperature approaches the predetermined overheat temperature.

5. The method of claim 1, wherein the step of providing the light indicator mechanism further comprises the light indicator mechanism comprising a multi-color light emitting device that emits a different color light for each of the first and second light conditions.

6. A shredder having motor driven shredder blades and an associated safety feature, comprising:

a shredder head housing defining a slot adapted to receive material to be shredded;

a plurality of shredder blades disposed within the shredder head housing and adapted to shred the material inserted into the slot;

a motor disposed within the shredder head housing and configured to drive the plurality of shredder blades;

a controller disposed at least partially within the shredder head housing and adapted to directly measure and monitor a temperature of the motor;

a light indicator mechanism located on the shredder and being under operative control of the controller, wherein the controller causes the light indicator mechanism to generate a first light condition when the motor temperature exceeds normal temperature parameters but is less than a predetermined overheat temperature, the controller causes the light indicator mechanism to generate a second light condition when the motor temperature is equal to or greater than the predetermined overheat condition to allow a user to modify shredder use to attempt to avoid an overheat situation while continuing to operate the shredder to shred material without the motor being deactivated.

7. The shredder of claim 6, wherein the light indicator mechanism comprises two light emitting elements each emitting light of a different color and configured to generate first and second light conditions; and reducing power to the motor when the motor temperature exceeds normal temperature parameters but is less than a predetermined overheat temperature to extend an amount of time remaining prior to the temperature of the motor becoming equal to or greater than the predetermined overheat condition.

8. The shredder of claim 6, wherein the light indicator mechanism comprises two light emitting elements, a first light emitting element providing a generally yellow light while the light indicator mechanism is generating the first light condition, a second light emitting element providing generally red light while the light indicator mechanism is generating the second light condition.

9. The shredder of claim 6, wherein the light indicator mechanism further comprises a plurality of generally lights that activate sequentially as the temperature approaches the predetermined overheat temperature.

10. The shredder of claim 6, wherein the light indicator mechanism comprises a multi-color light emitting device that emits a different color light for each of the first and second light conditions.

11. A method of shredding using a shredder having motor driven shredder blades and an associated safety feature, comprising:

providing a shredder head housing defining a slot adapted to receive material to be shredded; providing a plurality of shredder blades disposed within the shredder head housing and adapted to shred the material inserted into the slot;

providing a motor disposed within the shredder head housing and configured to drive the plurality of shredder blades;

monitoring the temperature of the motor;

providing a light indicator mechanism located on the shredder that is configured to be activated depending on the temperature of the motor, the light indicator mechanism generating a first light condition when the motor temperature exceeds normal temperature parameters but is less than a predetermined overheat temperature, the light indicator mechanism generating a second light condition when the motor temperature is equal to or greater than the predetermined overheat condition; and sensing and directly measuring the motor temperature and generating appropriate signals via the light indicator mechanism to generate a warning when a potential impending overheat temperature is detected to allow a user to modify shredder use to attempt to avoid an overheat situation while continuing to operate the shredder to shred material without the motor being deactivated.

12. The method of claim 11, wherein the step of providing the light indicator mechanism further comprises the light indicator mechanism comprising two light emitting elements each emitting light of a different color and configured to generate the first and second light conditions; and reducing power to the motor when the motor temperature exceeds normal temperature parameters but is less than a predetermined overheat temperature to extend an amount of time remaining prior to the temperature of the motor becoming equal to or greater than the predetermined overheat condition.

13. The method of claim 11, wherein the step of providing the light indicator mechanism further comprises the light indicator mechanism comprising at least two light emitting elements, a first light emitting element providing generally yellow light while the light indicator mechanism is generating the first light condition, and a second light emitting element providing generally red light while the light indicator mechanism is generating the second light condition.

14. The method of claim 13, wherein the step of providing the light indicator mechanism further comprises a plurality of generally lights that activate sequentially as the temperature approaches the predetermined overheat temperature.

15. The method of claim 11, wherein the step of providing the light indicator mechanism further comprises the light indicator mechanism comprising a multi-color light emitting device that emits a different color light for each of the first and second light conditions.

16. The method of claim 11, wherein the step of providing the light indicator mechanism further comprises a plurality of generally lights that activate sequentially as the temperature approaches the predetermined overheat temperature.

17. The method of claim 11, wherein the step of providing the light indicator mechanism further comprises an array of lights that activate sequentially as the temperature approaches the predetermined overheat temperature.

* * * * *